United States Patent [19]

Dalton

[11] 4,447,056

[45] May 8, 1984

[54] FOOTBALL TRAINING APPARATUS

[76] Inventor: Tom E. Dalton, Rte. 6, Box 96, Galax, Va. 24333

[21] Appl. No.: 411,897

[22] Filed: Aug. 26, 1982

[51] Int. Cl.[3] ..... A63B 67/00

[52] U.S. Cl. ..... 273/55 R

[58] Field of Search ..... 273/55 A, 55 R; 272/77; 434/267

[56] References Cited

U.S. PATENT DOCUMENTS

| | | | |
|---|---|---|---|
| 1,906,693 | 5/1933 | Laughlin | 273/55 A |
| 1,962,088 | 6/1934 | Crowther | 273/55 |
| 2,073,508 | 4/1936 | Gilman | 273/55 A |
| 2,088,861 | 8/1937 | Klum | 273/55 R |
| 2,820,365 | 1/1958 | Detzel | 73/380 |
| 2,934,343 | 4/1960 | Schumacher | 273/55 R |
| 3,216,724 | 11/1965 | Williams | 273/55 R |
| 3,398,953 | 8/1968 | Thompson | 273/55 |
| 3,399,891 | 9/1968 | McCormick et al. | 273/55 R |
| 3,451,677 | 6/1969 | Nedwick | 273/55 R |
| 3,514,105 | 5/1970 | Pillard | 273/55 |
| 3,680,861 | 8/1972 | Schmidt | 273/55 R |
| 3,684,283 | 8/1972 | Forrest | 273/55 R |
| 3,890,723 | 6/1975 | Haurat et al. | 434/267 |
| 4,087,089 | 5/1979 | Forrest | 273/55 R |
| 4,186,922 | 2/1980 | Ketchum | 273/55 R |

*Primary Examiner*—Richard C. Pinkham
*Assistant Examiner*—T. Brown

[57] ABSTRACT

The invention presented herein includes blocking apparatus which is wheeled for ease in transportation and which includes a blocking dummy having an outer surface with an inclined groove therein to assist in blocking exercises. The blocking dummy is mounted to an arm which pivots and also includes a column member which is spring-loaded and thereby can provide multi-directional movement for the dummy during training exercises.

4 Claims, 4 Drawing Figures

FOOTBALL TRAINING APPARATUS

BACKGROUND AND OBJECTIVES OF THE INVENTION

Blocking sleds are well known to football players and others which includes a padded member or dummy for offensive linemen to practice their blocking techniques. Conventionally, two or more players practice blocking against the sled on signal from a coach and the sled is driven along the ground by the players to increase their strength and blocking durability. Some prior art training sleds have employed resilient or yieldable dummy members in an effort to assist the players in improving their lateral movement and blocking techniques. However, during actual play opposing players often move in various directions different from that expected by the blocker and consequently the thrown block is of very short duration and of little value. Also, to increase the effectiveness and duration of a block offensive linemen are usually taught to block with their elbow lifted up forward of their shoulder to form a v-shaped notch by the head and the shoulder/arm to "grip" the defensive lineman. Conventional blocking training aids do not adequately assist in teaching the proper "feel" of a correct "grip" or blocking posture and therefore are inadequate for this purpose since they have generally a uniform surface. Additionally, conventional blocking sleds while somewhat useful in certain training circumstances, often have to be moved by sliding them over long distances by attendants or teaching personnel and this movement is often a laborious task which is required before and after daily practice sessions.

With the disadvantages of conventional training equipment in mind the present invention was conceived and one of its objectives is to provide a football training device comprising blocking apparatus having a blocking dummy member with multi-directional movements.

It is another objective of the present invention to provide an apparatus in which the movement of the blocking dummy can be limited or increased as required during training sessions.

It is still another objective of the present invention to provide blocking apparatus with a blocking member having the outer surface contoured to form a groove therein to provide players with the proper "feel" of an effective block.

It is still another objective of the present invention to provide a dummy member to which extra weight can be added as required for use by larger and stronger players.

It is still another objective of the present invention to provide a blocking apparatus having a pivotally attached arm member with yieldable dummy members attached at both ends of said arm member.

Other objectives and advantages of the present invention will become apparent in accordance with the details presented below.

SUMMARY OF THE INVENTION AND DESCRIPTION OF THE PREFERRED EMBODIMENT

The present invention comprises blocking apparatus for training football players or the like and includes a dummy member against which a blocking trainee such as an offensive lineman can practice his blocking techniques. The apparatus of the invention includes a wheeled cart which can be secured into position by a braking mechanism and includes a trunnion member which rotates approximately 180°. The trunnion member has attached thereto an arm member which provides a suspension mechanism for a dummy blocking member. The dummy member is joined to the arm member whereby the dummy member can swing in pendulum fashion and can also move in and out relative to the arm member. The blocking dummy herein described includes a groove in the outer surface which the blocking trainee can utilize in perfecting his blocking techniques.

The preferred embodiment of the blocking apparatus comprises a cart or frame member having four wheels attached thereto and includes a braking mechanism similar to conventional automobile parking brakes. The brakes can be employed or released and if employed can be partially or totally set to provide a variable resistance to the movemnt of the cart. A detachable tongue member is provided which will allow ease of movement to or from storage by maintainence personnel. The preferred form of the invention also includes a spring-loaded arm member which is pivotally connected to the frame member by a trunnion which can be locked into place if desired. The arm member includes a suspension mechanism for a pair of dummy members which are cylindrical in shape and have groove therein which is biased from the horizon. The blocking dummy member when contacted, can move inwardly toward the arm member and first resilient member between the dummy member and the arm member causes the dummy member to move away from the arm member when contact is released therefrom. A second resilient member is attached to said frame member and to said arm member causing said arm member to return to its original position after any pivoting action of the arm member occurs. The dummy members are attached to the arm members also to swing in pendulum fashion from side to side and this motion, along with the inward and outward movement, or the pivoting action of the trunnion can be halted as desired by employing various locking means.

The preferred form of the blocking dummy member having a longitudinal axis and a transverse axis comprises a cylindrical shaped bag whereby the outer surface forms a groove therein, said groove extending at an angle less than 90 degrees to the transverse axis. The lower end of the groove is larger than the upper portion and said groove extends approximately one-half the circumference of the cylindrical configuration. The outer surface of the blocking dummy may be formed from a durable canvas material or the like or may be formed from other tough, resilient materials such as a suitable vinyl material and may be filled with cotton or other synthetic or natural fibers or the like. The dummy member of the preferred embodiment also includes a closable opening whereby weight can be added to the dummy member by the addition of sand or other suitable materials. Handles or the like are placed along the upper portion of the dummy members whereby the dummy member can be used independently of the blocking apparatus described herein by a coach or other designated personnel by holding the dummy member in a secure position during tranining drills.

Figure 1:
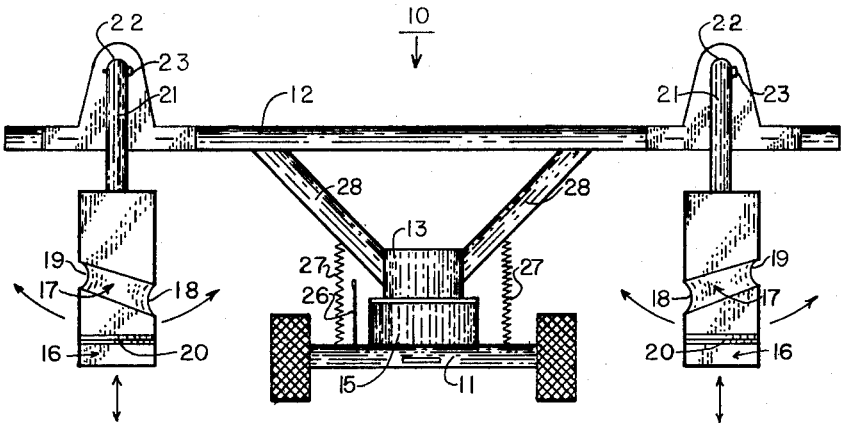
FIG. 1 illustrates a front elevational view of the blocking apparatus of the present invention.

For a more detailed description of the invention and its operation, FIG. 1 demonstrates blocking apparatus having a cart or frame member 11 and arm member 12 which is pivotally joined to frame member 11 by trunnion 13. As it would be understood trunnion 13 rotates approximately 180° as required or can be locked into place to prevent rotation by locking means 14 which comprises a steel locking pin. Locking pin 14 prevents trunnion means 13 from rotating on trunnion base 15 which is secured to frame member 11. Blocking dummy members 16 are shown suspended from arm member 12 on either side of frame member 11 and biased groove 17 are shown formed in the outer surface of dummy member 16. Groove 17 are shown positioned on a bias to the horizon and include a wider lower portion 18 and a narrow upper portion 19. The purpose of groove 17 is to allow the blocking trainee to "throw" a correct block and to determine the feel of such a block so that he becomes accustomed to it when "hitting" an opposing player. Zipper means 20 will allow the dummy member to be opened for inserting sand or other weighted materials therein to provide a heavier blocking member for larger or stronger players.

Dummy members 16 as suspended from apparatus 10 as shown in FIG. 1 can each be hit by two players simultaneously or as nearly at the same time as possible and coaching personnel can use the pivoting effect of blocking apparatus 10 to determine which player, on a given signal, blocked which dummy member 16 first by the movement of arm member 12. Also, coaches may wish to increase the strength of the leg muscles of their players by simply having them to drive their respective blocking dummy members forward 10 or 12 yards at a time and during such exercises, locking means 14 may be utilized preventing the pivotable motion of trunnion 13. Tongue members 31 is detachable and provides a convenient handle for transporting blocking apparatus 10 to and from practice sessions.

Figure 3:
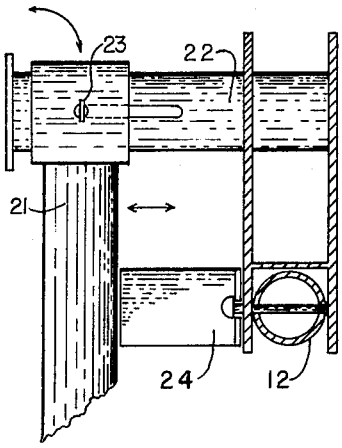
FIG. 3 illustrates the suspension member of the blocking member.

To increase the realistic effect of actual game blocking, dummy member 16 will move in a pendulum fashion from right to left as shown in FIG. 1 as column means 21 is rotatably joined to column support means 22 as shown in FIG. 3. If it is desirable, in certain training exercises to prevent the pendulum motion of dummy member 16 and to prevent the inward and outward movement of dummy member 16 relative to arm member 12, column locking means 23 is inserted which prevents such movement. Column locking means 23 may be for example a steel pin which passes through column 21 and column support means 22.

As further shown in FIG. 3 column 21 is in juxtaposition to first resilient member 24. First resilient member 24 may be for example a leaf spring means and as shown in FIG. 3 is in juxtaposition to column means 21 to resist the inward motion of blocking member 16 (not shown in FIG. 3). As blocking member 15 is urged inwardly toward arm member 12 resilient member 24 supplies a reactive (resistive) force thereto.

Figure 2:
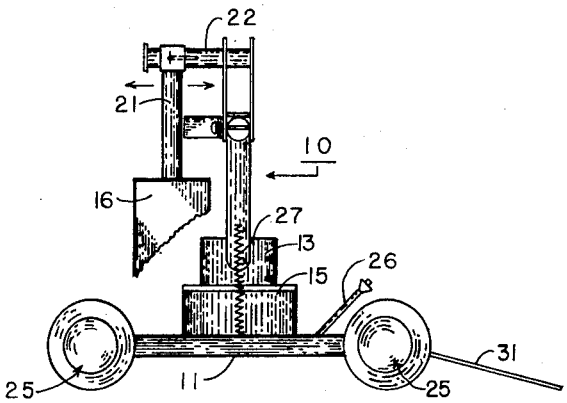
FIG. 2 demonstrates a side elevational view of the apparatus as shown in FIG. 1.

FIG. 2 demonstrates a cart or frame member 11 having wheel members 25 joined thereto. Brake handle means 26 which attaches to a conventional parking brake system (not shown) allows the user to adjust the brake pressure on wheel members 25, or allows the user to completely remove the braking forces therefrom. Second resilient means 27 is shown in FIG. 2 which may be for example a coil spring which is connected to frame member 11 and to column support member 28. Second resilient means 27 returns arm member 12 to its original position as shown in FIG. 1 after an offsetting pressure such as may be applied to either blocking member 16, is removed therefrom.

Figure 4:
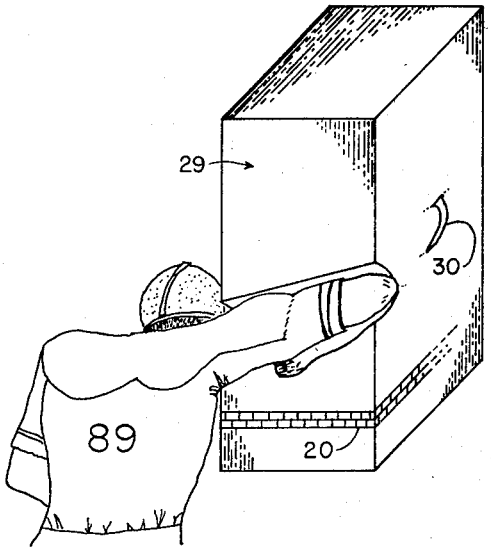
FIG. 4 shows one embodiment of the blocking dummy being used.

Groove 17 as shown in cylindrical blocking dummy 16 of FIG. 1 allows the players, generally offensive linemen, to practice receiving the feel of a proper block against defensive linemen. Groove 17 allows the blocking trainee to "grip" the defensive linemen in a substantially "v-shaped" configuration formed between the head/neck and shoulder/arm as shown in FIG. 4. Blocking dummy member 29 as further shown in FIG. 4 is not suspended from any apparatus and therefore does not contain column 21 but instead is positioned on the ground of the practice field and is held by one or more handle means 30 by a coach or other training personnel to provide a close look at the trainee's blocking technique. Dimensions of the particular blocking dummy member may vary but a typical dummy member as shown in FIG. 4 for high school players has been formed to be fifty-two (52) inches in height, eighteen (18) inches wide and twenty (20) inches in depth. Dummy blocking member 29 may have a rectangular rather than circular cross-section and may contain zipper means 20 to provide access to an interior pocket for adding weights to blocking member 29 as required. The groove may extend approximately half the circumference of a cylindrically-shaped dummy member, yet may be positioned on only one side of a cubically shaped dummy member or a dummy member having a rectangular cross-section.

Once the trainee has learned the proper blocking technique by a hand held blocking member such as shown in FIG. 4 he can then more ably use and train with blocking apparatus 10 as shown in FIG. 1.

Various modifications and improvements can be made to the device as shown herein and the examples and illustrations are for explanatory purposes and are not intended to limit the scope of the invention.

What I claim is:

1. Blocking apparatus comprising: a frame member, said frame member having wheels positioned thereon, an arm member, said arm member pivotally attached to said frame member, a blocking member having a horizontal axis and a transverse axis, said blocking member attached to said arm member, said blocking member having an outer surface, said outer surface contoured to form a groove, said groove extending at an angle less than 90 degrees to said transverse axis for assisting in blocking exercises.

2. Blocking apparatus as claimed in claim 1 wherein said blocking member includes a column, and said column is pivotally attached to said arm member.

3. Blocking apparatus as claimed in claim 1 wherein said arm member includes a first resilient member, and said first resilient member contacts said blocking member.

4. Blocking apparatus as claimed in claim 1 and including second resilient member, and said second resilient member is joined to said frame member and to said arm member.

* * * * *